United States Patent [19]

Nagashima et al.

[11] 3,985,099

[45] Oct. 12, 1976

[54] MAGNETIC BRUSH DEVELOPING DEVICE

[75] Inventors: Toshio Nagashima; Mitsuharu Nakaguchi; Takuzo Tsukamoto; Ryuzo Okada; Hidetoshi Kito; Kenichi Handa, all of Ebina, Japan

[73] Assignee: Fuji Xerox Co., Ltd., Tokyo, Japan

[22] Filed: May 13, 1975

[21] Appl. No.: 576,997

[30] Foreign Application Priority Data

May 13, 1974 Japan ..... 49-52303

[52] U.S. Cl. ..... 118/637; 355/3 DD; 427/18

[51] Int. Cl.[2] ..... B05B 5/02; G03G 13/09; G03G 15/09

[58] Field of Search ..... 118/637; 427/18; 355/3 DD

[56] References Cited

UNITED STATES PATENTS

| | | | |
|---|---|---|---|
| 3,457,900 | 7/1969 | Drexler | 118/637 |
| 3,543,720 | 12/1970 | Drexler et al. | 118/637 |
| 3,641,980 | 2/1972 | Bickmore | 118/637 |
| 3,654,902 | 4/1972 | Hakanson | 118/637 |
| 3,724,422 | 4/1973 | Latone et al. | 118/637 |
| 3,855,969 | 12/1974 | Andrako | 118/637 |
| 3,908,595 | 9/1975 | Okada | 118/637 |
| 3,937,181 | 2/1976 | Handa | 118/637 |

FOREIGN PATENTS OR APPLICATIONS

| | | | |
|---|---|---|---|
| 40-17,228 | 8/1965 | Japan | 118/637 |

OTHER PUBLICATIONS

IBM Technical Disclosure Bulletin, Development of Electrostatic Images, by H. C. Medley, vol. 2, No. Aug. 1959.

*Primary Examiner*—James Kee Chi
*Attorney, Agent, or Firm*—Gerald J. Ferguson, Jr.; Joseph J. Baker

[57] ABSTRACT

In a magnetic brush developing device, the improvements comprising a plurality of developing rollers consisting of cylindrical stationary magnets each having a developing magnetic pole and disposed in facing relation to the surface of latent image forming member, and cylindrical sleeves rotating around each of said stationary magnets, said plurality of developing rollers being arranged along the surface of said latent image forming member in a manner that the developing magnetic poles have alternately opposite polarities, whereby delivery and receipt of the developing agent between the adjacent developing rollers are effected between the developing magnetic poles of adjacent developing rollers.

3 Claims, 2 Drawing Figures

MAGNETIC BRUSH DEVELOPING DEVICE

BACKGROUND OF THE INVENTION

1. Field of the Invention

This invention relates to a magnetic brush developing device for developing an electrostatic latent image formed by an electrophotographic process, and more particularly to a magnetic brush developing device, wherein magnets are used for producing a brush-like bur of a developing agent consisting of iron powder carrier and toner, the aforesaid brush-like bur of developing agent sliding along the surface of latent image, thereby developing same to a visual image.

2. Description of the Prior Art

The magnetic brush developing device has been well known as a developing device for use in a dry type electrophotographic reproducing apparatus and is particularly useful for reproduction of a solid black portion or half-tone portion, rather than the cascade development is.

If the magnetic brush developing device equipped with a single magnetic roller is employed for a high speed reproducing apparatus, it follows that a developing time is compressed, and the feeding of an adequate amount of toner to the latent image is failed, resulting in the unsatisfactory developing in the solid black portion.

Increase in reproduction speed of a reproducing apparatus is the needs of the times. For meeting the requirements, various attempts have hitherto been made, as a result of which there has been proposed a device, in which a plurality of magnetic rollers are employed for compensating for reduction in developing time per roller. In the device, a plurality of developing rollers are provided in vertically paralled relation to one another along the latent image formed surface of a sensitive member. The device, however, suffers from the drawbacks that when a developing agent fed to the preceding developing roller is fed successively to the succeeding rollers, uniform delivery of the developing agent between the adjacent rollers is failed, resulting in the concentration of the developing agent to only a single roller, the local accummulation of the developing agent or leakage to the outside of the developing device.

SUMMARY OF THE INVENTION

It is accordingly an object of the present invention to provide a magnetic brush developing device, wherein delivery of a developing agent between the adjacent magnetic rollers, i.e. transportation of a developing agent, is improved, thereby permitting a satisfactory reproduction of a solid black portion, even for a high speed reproduction.

Respective magnetic roller used in the present invention is of a cylindrical magnet, which is surrounded by a rotatable non-magnetic sleeve. In the stationary magnet, rotary sleeve type magnetic roller, the magnet may serve to transport a developing agent as well as to develop a latent image, unlike the rotary magnet type magnetic roller, and the cylindrical magnet is more efficient for producing a bur of developing agent, as compared with an angular magnet. In other words, the former permits formation of a bur of developing agent in opposite ends in the axial direction of roller.

The present invention also relates to magnetization pattern on a cylindrical magnet of each of the aforesaid stationary magnet, rotary sleeve type cylindrical magnets, and is directed to providing developing rollers which are improved in transportation of a developing agent.

DETAILED DESCRIPTION OF THE PREFERRED EMBODIMENT

Description will hereunder be given to an embodiment of the present invention in conjunction with the accompanying drawings.

Figure 1:
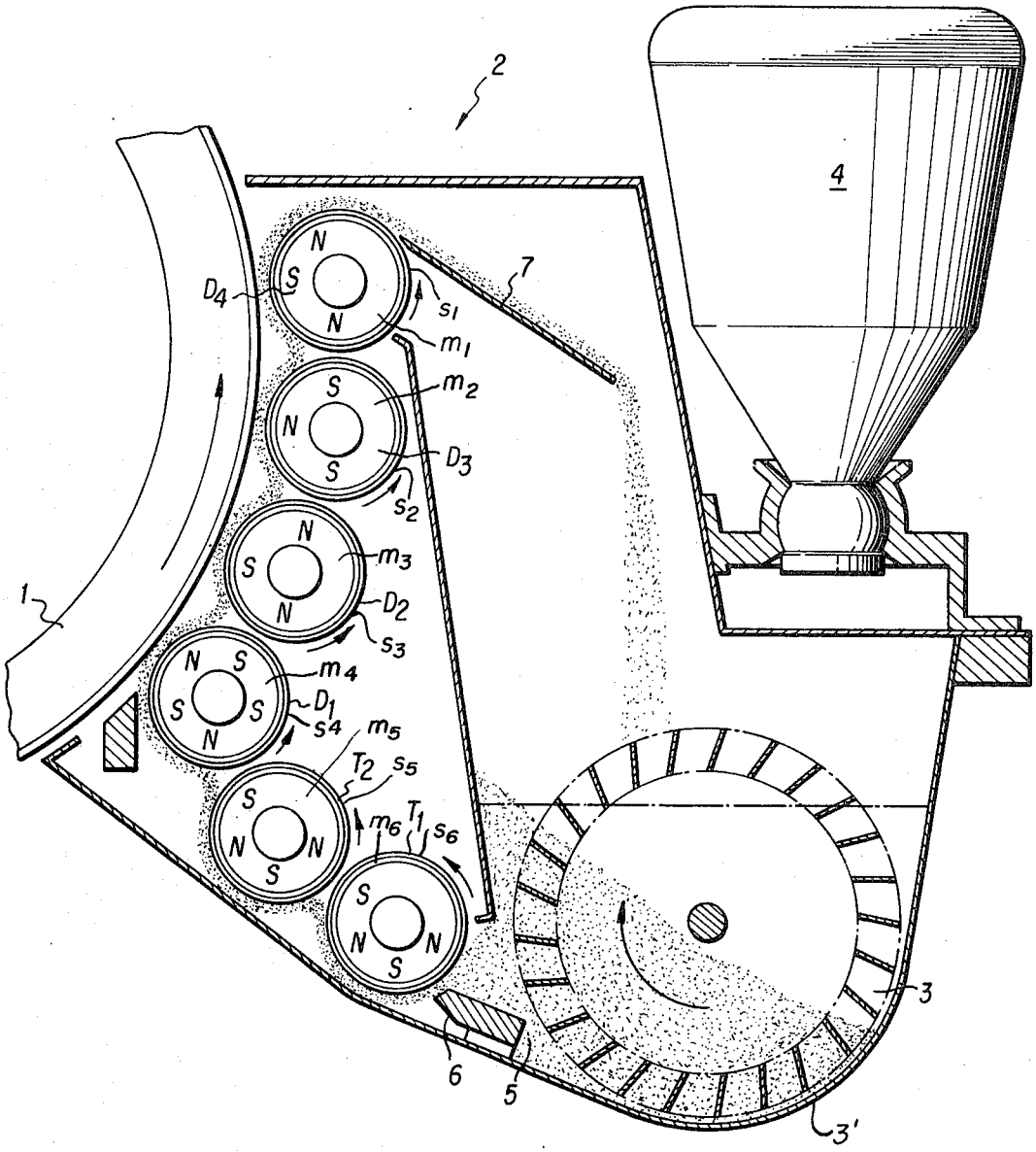
FIG. 1 illustrates the outline of the developing device in which the present invention is realized; and, FIG. 2 is a diagramatical view showing the arrangement of the magnetic poles of respective magnetic rollers of an embodiment of the present invention.
Figure 2:
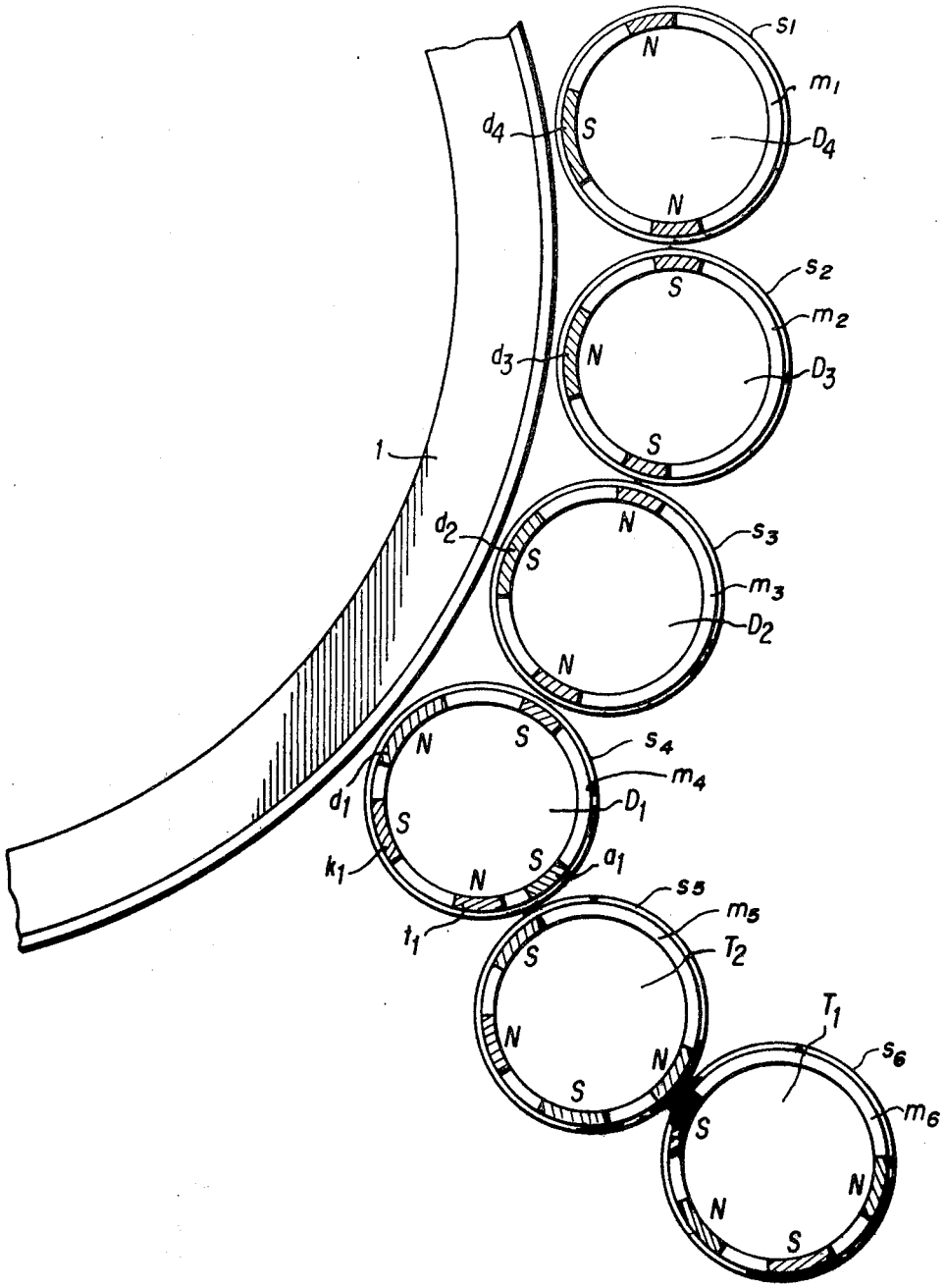

FIG. 1 illustrates the status in which an electrostatic latent image formed on a latent image forming member 1 according to the electric charging and exposure steps is being developed in a developing device 2. A paddle wheel 3 serves to feed to a transporting magnetic roller $T_1$ a developing agent 5 consisting of iron powder carrier and toner which is fed by a proper amount from a toner bottle 4. The developing agent, whose amount is controlled by a trimmer blade 6, is delivered to a transporting magnetic roller $T_2$, and then transported to developing rollers $D_1$, $D_2$, $D_3$ and $D_4$ successively. Then, the developing agent is scraped off from the developing roller $D_4$ by a pick-off baffle 7 to be recovered to the developing agent reservoir. While the developing agent is transported from the developing roller $D_1$ to the developing roller $D_4$, toner contained in the developing agent is alone attracted to the latent image. Accordingly, toner is supplied to the reservoir 3' from the toner bottle 4 by an amount commensurate with the consumed toner. The rollers $D_1 - D_4$ and $T_1$ and $T_2$ respectively comprise cylindrical magnets $m_1 - m_6$ and sleeves $s_1 - s_6$ rotatably mounted thereabout where the sleeves $s_1 - s_6$ are shown in FIG. 2 as only a single line for ease of illustration.

The developing agent travels along the developing rollers in the form of layer as shown in FIG. 1, without clinging to the surfaces of developing rollers. This is owing to magnetization pattern on the magnets of each developing roller, as shown in FIG. 2.

The developing rollers $D_1$, $D_2$, $D_3$ and $D_4$ have developing magnetic poles $d_1$, $d_2$, $d_3$ and $d_4$ in a portion facing the surface of latent image forming member 1, respectively. Each developing magnetic pole covers a sufficiently wide area on the peripheral surface of each roller, such that same serves to develop the latent image to a visual image as well as to transport the developing agent between the adjacent developing rollers. Respective developing rollers are alternately magnetized with an opposite polarity in such a manner that $d_1$ is a north pole, $d_2$ a south pole, $d_3$ a north pole and $d_4$ a south pole, such that the developing agent may be delivered between the adjacent developing magnetic poles.

Magnetic poles disposed on the opposite sides of each developing magnetic pole in the rotating direction of the roller are magnetic poles accruing from the manufacture of the cylindrical magnet, the aforesaid magnetic poles having an opposite polarity to the polarity of each developing magnetic pole and contributing neither to developing the latent image nor to transporting the developing agent, except for one magnetic pole $k_1$ of the developing roller $D_1$. In the embodiment shown, to increase leakage flux from developing magnetic poles at the maximum, those magnetic poles are arranged as near to respective developing magnetic poles as possible and in a portion facing the vertically arranged adjacent magnetic rollers, which portion is independent of transportation of the developing agent. As seen from the developing roller $D_1$, a transporting magnetic pole $t_1$ or an auxiliary transporting magnetic pole $a_1$ may be provided so as to facilitate receipt of the developing agent by the developing roller $D_1$ from the transporting roller $T_2$.

The developing agent, which has been transported to the developing roller $D_1$ by means of the transporting rollers $T_1$ and $T_2$, is received on the transporting magnetic pole $t_1$ and then shifted by means of the magnetic pole $k_1$ to the developing magnetic pole $d_1$. The developing magnetic pole $d_1$ covers a sufficiently wide area on the roller surface $D_1$ in facing relation to the surface of latent image forming member 1, such that the developing agent may slide the whole surface of latent image, thereby achieving the satisfactory developing of the latent image. The developing agent being transported with rotation of the sleeve is directly delivered to the developing magnetic pole $d_2$ of succeeding developing roller $D_2$ from the developing magnetic pole $d_1$ of preceding developing roller $D_1$.

The developing agent is transported to the developing roller $D_4$ in like manner and then scraped off from the developing roller $D_4$ by means of the pick-off baffle to be returned to the developing agent reservoir.

Thus, the developing agent is transported along developing rollers without passing to the rear surface of developing roller and without undergoing any physical force.

Reference has had to the embodiment in which four developing rollers are employed for transporting the developing agent from below towards above of the developing device. The number of the developing roller is variable according to the reproduction speed. Change in the number of developing roller requires change in position of magnetic poles. In case the developing agent is transported from above of the developing device towards below, the position of the magnetic poles be necessarily altered. Those change and modifications are included within the scope of the invention.

Since the developing device of the present invention provides a sufficiently long span of developing area and is improved in transportation of the developing agent, there is obtained a high quality copy and life of the developing agent is extended.

While the invention has been described in detail and with reference to specific embodiments thereof, it will be apparent to one skilled in the art that various changes and modifications can be made therein without departing from the spirit and scope thereof.

What is claimed is:

1. In a magnetic brush developing device, the improvements comprising;

a plurality of developing rollers consisting of cylindrical stationary magnets each having a developing magnetic pole and disposed in facing relation to the surface of latent image forming member, and cylindrical sleeves rotatably mounted around each of said stationary magnets, said plurality of developing rollers being arranged along the surface of said latent image forming member so that the developing magnetic poles have alternately opposite polarities, whereby delivery and receipt of the developing agent between the adjacent developing rollers are effected between the developing magnetic poles of adjacent developing rollers;

each said cylindrical stationary magnet having, in addition to its developing magnetic pole, a pair of further magnetic poles disposed on the opposite sides of their associated developing magnetic pole, at least some of said cylindrical stationary magnets having only their developing magnetic pole and pair of further magnetic poles disposed thereon, said further magnetic poles having polarities opposite to that of their associated magnetic pole, at least some of said further magnetic poles of each cylindrical stationary magnet directly facing adjacent further magnetic poles of opposite polarity disposed on adjacent cylindrical stationary magnets such that the said some further magnetic poles contribute neither to the development of said latent image nor to the transportation of said latent image while at the same time the leakage flux from the developing magnetic poles associated with said some further magnetic poles is maximized.

2. The improvements in claim 1 where said further magnetic poles which directly face each other are each approximately symmetrically disposed about an imaginary plane which extends through the centers of said cylindrical stationary magnets.

3. The improvements as in claim 2 where the first of said developing rollers to which the developing agent is delivered has an auxiliary transporting magnetic pole disposed adjacent one of its further magnetic poles and on the side thereof opposite its developing magnetic pole, the polarity of said auxiliary transporting magnetic pole being opposite to that of the adjacent further magnetic pole.

* * * * *